US006898886B1

(12) United States Patent
Montecalvo

(10) Patent No.: US 6,898,886 B1
(45) Date of Patent: May 31, 2005

(54) ADJUSTABLE FRAME FOR DISPLAYING OBJECTS

(76) Inventor: Lawrence G Montecalvo, 286 Lawrence Ave. NE., Warren, OH (US) 44483

( * ) Notice: Subject to any disclaimer, the term of this patent is extended or adjusted under 35 U.S.C. 154(b) by 0 days.

(21) Appl. No.: 10/659,897

(22) Filed: Sep. 11, 2003

(51) Int. Cl.[7] ..... A47G 1/08
(52) U.S. Cl. ..... 40/740; 40/782; 40/785
(58) Field of Search ..... 40/700, 739, 740, 40/743, 781, 782, 785

(56) References Cited

U.S. PATENT DOCUMENTS

| | | | | | |
|---|---|---|---|---|---|
| 3,899,844 | A | * | 8/1975 | Munn | 40/794 |
| 3,955,298 | A | * | 5/1976 | Kapstad | 40/782 |
| 3,965,601 | A | * | 6/1976 | Nielsen | 40/782 |
| 4,209,922 | A | | 7/1980 | Porreca | |
| 4,348,127 | A | * | 9/1982 | Hays, Jr. | 40/782 |
| 4,676,686 | A | * | 6/1987 | Eisenloffel | 40/785 |
| 4,718,184 | A | * | 1/1988 | Sherman | 40/785 |
| 4,794,714 | A | | 1/1989 | Weisgerber | |
| 4,949,483 | A | | 8/1990 | Dobson et al. | |
| 5,419,064 | A | * | 5/1995 | Bennett | 40/782 |
| 5,515,630 | A | | 5/1996 | Maher | |
| 5,546,689 | A | | 8/1996 | Bomze | |
| 5,579,596 | A | | 12/1996 | Kovacs et al. | |
| 5,692,333 | A | * | 12/1997 | McClave | 40/785 |
| 5,799,430 | A | * | 9/1998 | Fremstad | 40/785 |
| 6,055,757 | A | | 5/2000 | Carlsson | |
| 6,339,891 | B1 | * | 1/2002 | Cox | 40/785 |
| 6,578,305 | B2 | | 6/2003 | Lebrun | |
| 6,578,306 | B1 | | 6/2003 | Davis, Jr. | |

* cited by examiner

*Primary Examiner*—Gary C. Hoge
(74) *Attorney, Agent, or Firm*—Robert J. Herberger

(57) ABSTRACT

An adjustable frame for displaying three dimensional objects includes a peripheral border unit having segments with a front face and a channel extending along the segments, a side face formed integrally with the front face, keys for interconnecting the segments, a back panel, a retainer tab for contacting an outer surface of the back panel, a fastener including a head for retention within the channel and an elongated shank extending from the head for adjustably engaging the retainer tab along the shank and securing the back panel to the peripheral border unit. An outer surface of the front face of each segment having an ornamentally attractive façade. The frame may further include a second channel extending along the frame having an opening facing the back panel, a side panel for insertion in the second channel and extending from the front face toward the back panel to form a shadow box within the frame.

18 Claims, 5 Drawing Sheets

Figure 3
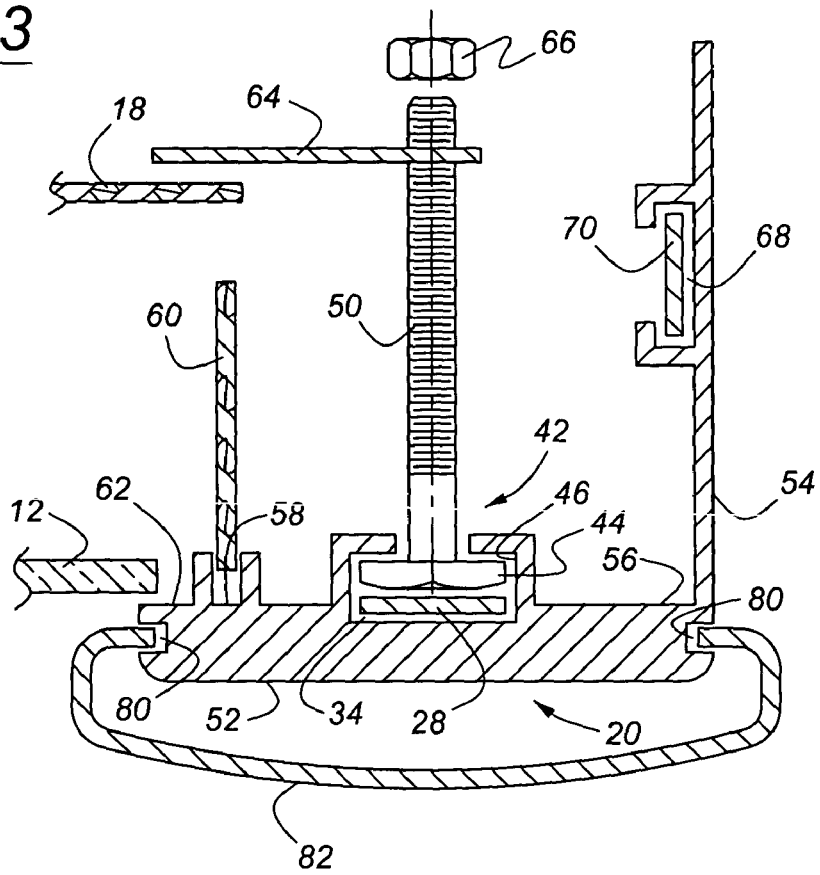
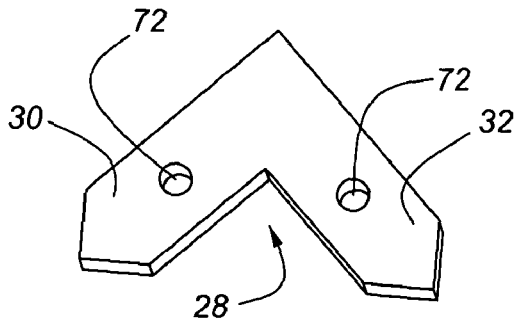
Figure 4
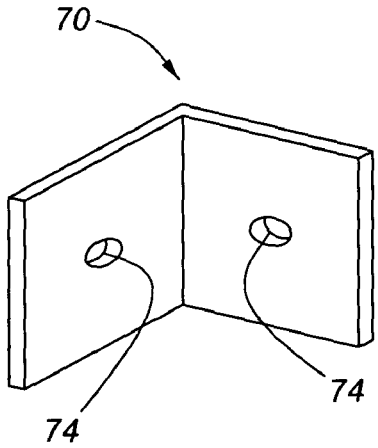
Figure 5

Figure 6
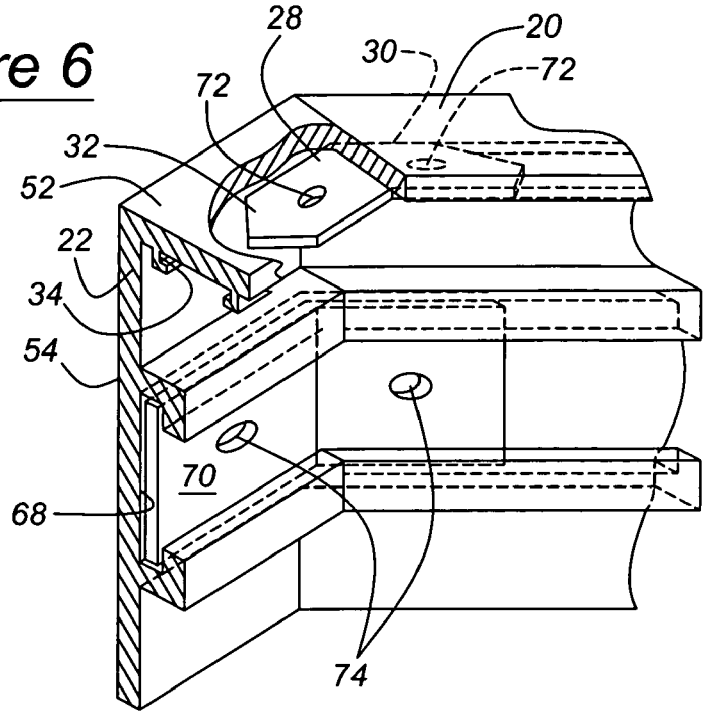
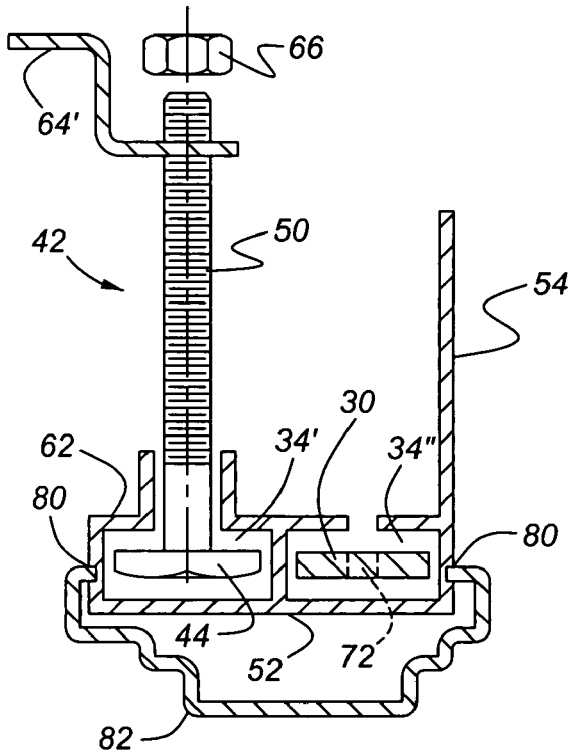
Figure 7A
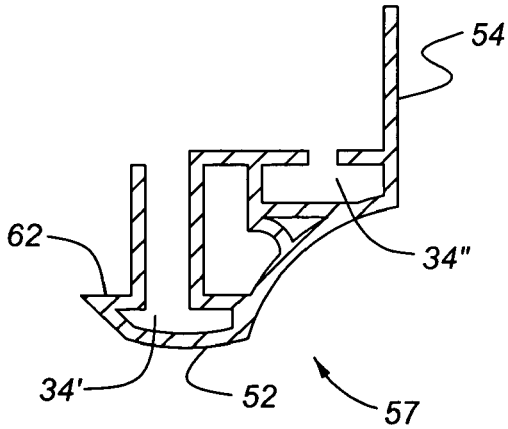
Figure 7B

ADJUSTABLE FRAME FOR DISPLAYING OBJECTS

BACKGROUND OF THE INVENTION

1. Field of the Invention

This invention relates to a frame assembly for displaying objects. More particularly, the invention pertains to a segmented frame having an adjustable depth to form a variable three dimensional enclosure.

2. Description of the Prior Art

Various devices are available for displaying three dimensional objects in a frame. U.S. Pat. No. 6,578,306 describes an apparatus for displaying such objects on a display panel that includes a panel layer formed of a penetrable, stiff material sandwiched between a layer of a penetrable, flexible sheet material and a layer of mesh material. The objects are held in position by wires looping about the objects and extending through the display panel. The depth of the display panel is not adjustable.

U.S. Pat. No. 6,578,305 illustrates and describes an adjustable framing system for three-dimensional objects having an access door in the rear that allows objects to be easily inserted, temporarily removed for examination, and then returned. The framing system has a deep compartment for holding publications having a variety of sizes by using matting in the front of a document, shims for vertically and horizontally locating the document in the frame, and back shims for locating the document correctly in the frame depth. Merely increasing the thickness of the backing shims changes the cavity depth. Separate display compartments are provided for displaying thin sheets of paper.

U.S. Pat. No. 4,949,483 discloses a display frame for holding a magazine or similar article to display the cover. The frame has a front piece and rear piece, the rear having a back and walls, the front having a bezel and walls. The walls telescope together forward and rearward, and ratchets and pawls hold a selected spacing between the front and rear pieces at a set position. Removable tabs in the frame can be broken out or retained to position the magazine within the frame for the desired aesthetic appearance. The depth of the cavity can be adjusted only by fitting a pawl in a ratchet recess. The front and back of the frame are each unitary, requiring no joints or attachments for connecting segments. The cavity depth is limited to the narrow range of displacement of the front and back portions of the frame, and its adjustability is limited to the spacing between the racket recesses.

The frame described in U.S. Pat. No. 4,209,922 includes a pair of edge members for engagement along opposite edges of a picture, and a pair of clamping assemblies, extending between the pair of edge members for holding the components in position. The depth of the space occupied by the display object is established by the thickness of a panel on which the object is mounted, similar to shimming. A screw passing through a backing engages a body portion of the frame of U.S. Pat. No. 4,794,714 and holds the display item fixed against the frame. There is no provision for adjusting the depth of the display cavity to suit the size of the object.

SUMMARY OF THE INVENTION

The invention relates to a frame having an adjustable depth feature for displaying planar and three-dimensional objects having various thicknesses. Books, magazines, or other such documents can be displayed using this invention.

The frame forms a three dimensional enclosure, whose depth can be varied readily by changing the operative length of a fastener secured to the frame and engaged by a threaded nut or other attachment. The frame is formed in segments that are keyed at the corners, and uses a continuous, peripheral channel to accept and engage the head of the fasteners.

A frame according to this invention for displaying an object, includes a peripheral border unit having a front face formed with a channel that extends along the peripheral border unit and has an opening facing rearward. A side face is formed integrally with the front face. A retainer tab contacts an outer surface of a back panel or, in the alternative, the framed object. A fastener includes a head retained within the channel and an elongated shank extending from the head through the opening, for adjustably engaging the retainer tab along the shank and securing the back panel to the frame. A second channel extending along the frame may be included, having an opening facing the back panel, and a side panel, inserted in the second channel, extends from the front face toward the back panel. The assembled frame then provides a display cavity that is closed along its edges by the side panels, at its front by glazing supported on the frame, and at its back by the back panel secured by retainer tabs.

The depth of the cavity is easily adjusted to accommodate the displayed object by adjusting the location of the retaining tab on the shank and by securing the nut on the shank so that the retaining tab contacts the back panel.

Various other objects and advantages of this invention will become apparent to those skilled in the art from the following detailed description of the preferred embodiment, when read in light of the accompanying drawings.

BRIEF DESCRIPTION OF THE DRAWINGS

It is to be understood that the drawings are designed for the purpose of illustration only and not as a definition of the limits of the instant invention, for which reference should be made to the claims appended hereto. Other features, objects and advantages of this invention will become clear from the following more detailed description made with reference to the drawings in which:

FIG. 3 is an end view of a frame segment showing the frame components in assembled position;

FIG. 4 is an isometric view of a corner key for engaging a channel in the front face;

FIG. 5 is an isometric view of a corner key for engaging a channel in the side face;

FIG. 6 is an isometric view of a corner where adjacent segments are secured by corner keys; and FIGS. 7A–7E are cross sections through the front and side faces of various frame configurations.

DETAILED DESCRIPTION OF THE PREFERRED EMBODIMENT

Figure 1:
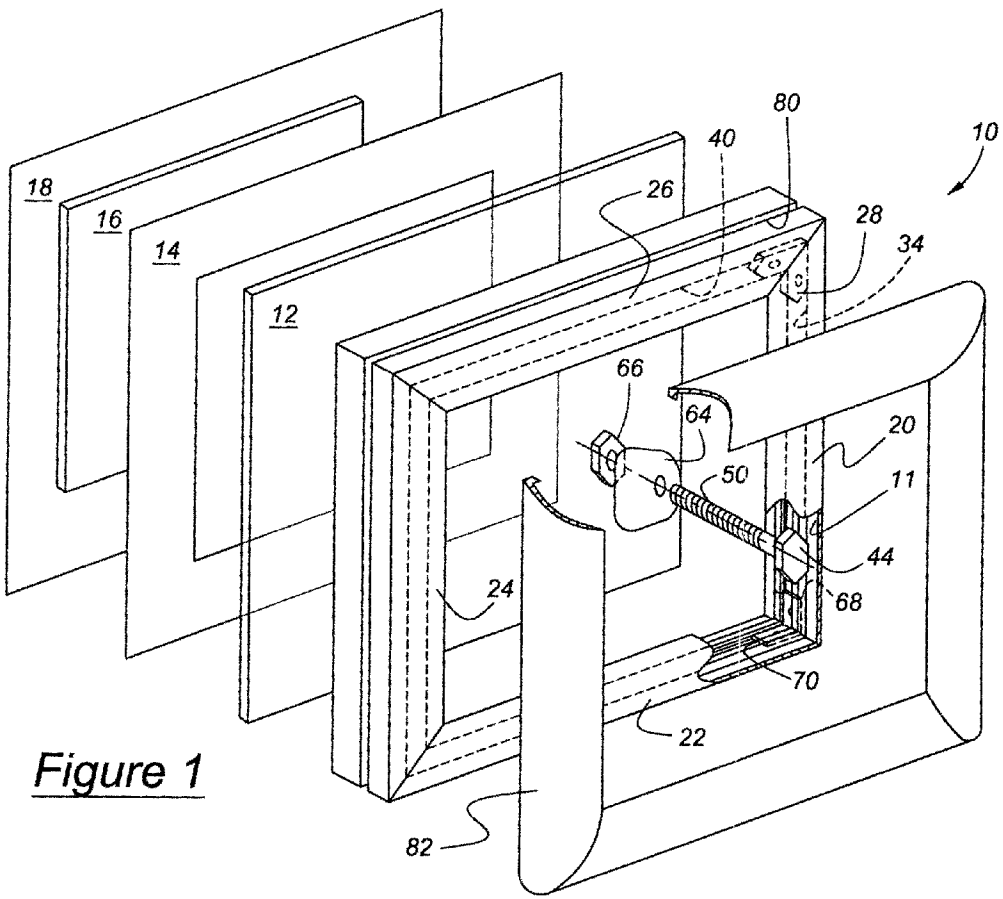
FIG. 1 is an exploded perspective view of a frame with a corner displaced to show a corner key and fastener for backing attachment.

Referring now to the drawings, there is illustrated in FIG. 1 an adjustable frame 10 having a peripheral border unit 11, sheet of glazing 12 such as glass, Plexiglas, acrylic or other transparent material supported thereon, a picture matting 14, the object to be framed 16, and a back panel 18. The peripheral border unit 11 of the frame is formed in segments 20, 22, 24, 26 connected at the corners. Although the frame border unit 11 is shown in rectangular form, it can have any number of sides. The frame segments 20, 22, 24, 26 are preferably of wood or extruded aluminum, but other materials are acceptable including plaster, acrylic, extruded plastic, or molded plastic. The cross section of each frame segment is substantially identical to that of the other segments.

Figure 2:
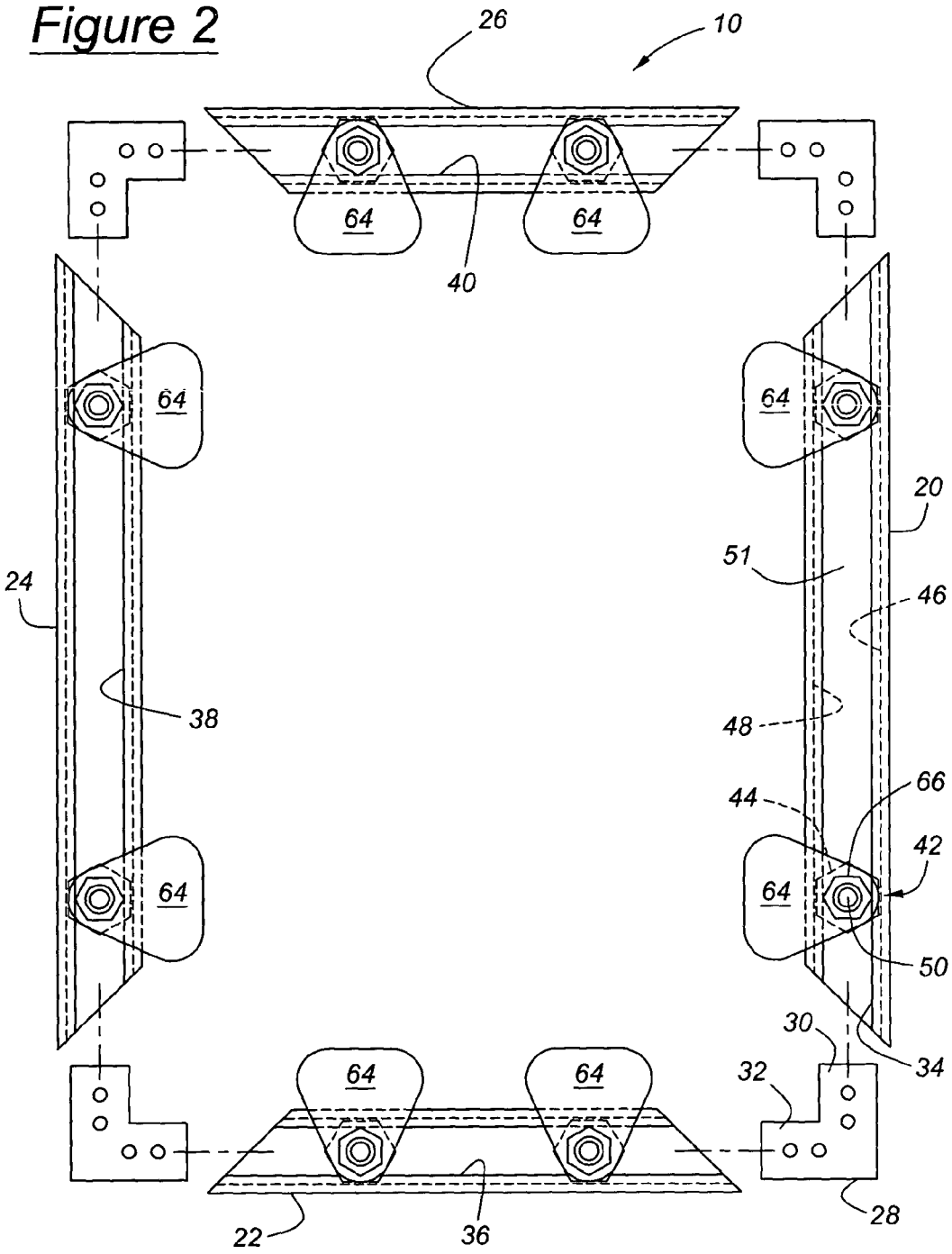
FIG. 2 is a back view of a frame assembly showing the parts in spaced relation.

As FIG. 2 shows, the frame segments are mutually connected at each corner by a track channel corner key 28 having a first leg 30 for engaging a track channel 34 in one segment 20, and a second leg 32 for engaging a track channel 36 in the segment 22 that is adjacent segment 20. The channels 34, 36 are mutually aligned and are aligned with corresponding channels 38, 40 in segments 24 and 26. In like fashion, channels 38, 40 are mutually aligned. Each channel extends along the length of the respective frame segment, and each frame segment is interconnected with the other segments by the engagement of the corresponding track channel corner key 28.

In one embodiment, at least one fastener 42 is located in each track channel 34, 36, 38, 40, such that the fastener does not interfere with the track channel corner key 28. Each fastener 42 includes a flanged head 44, preferably hexagonal, and the lateral surfaces of the head contacting the inner lateral surfaces, such as lateral surfaces 46, 48 of the track channel 34. This contact between the head and channel permits the fastener to slide along the channel length, but prevents the fastener from rotating relative to the peripheral border unit 11 of the frame 12. Each fastener includes a shank 50, preferably formed with external screw threads. The shank 50 extends rearward from the head 44 and a front face 52 of the peripheral border unit 11, through an opening 51 in the inner surface of the track channel 34, toward the back panel 18.

FIG. 3 is a cross sectional end view of a frame segment 20, the front face 52 of the peripheral border unit 11 facing downward, and a side face 54 of the border facing rightward. The inner surface 56 of the front face 52 is formed with track channel 34, which contains leg 30 of the track channel corner key 28 and the head 44 of fastener 42. Located at the inner surface 56 is a shadow box channel 58, which extends along the length of the frame segment 20, substantially parallel to the track channel 34. Shadow box channel 58 has a width and depth sized to receive and retain there a shadow box side panel 60. When the peripheral border unit of the frame is assembled, the panels 60 of each segment contact the back panel 18, close the inner edge of the frame, and preferably cover the track channel 34, fastener 42 and other details of the frame assembly from external view. The glazing 12 fits in a recess 62 located at the inner edge of the front face 52 of the frame's peripheral border unit 11. The recess 62 on the lower frame segment 22 supports the weight of the glazing.

Fastener 42 receives a retainer tab 64 fitted on the shank 50 for rotation about the shank to the position shown in FIG. 3 where the tab 64 overlaps the back panel 18 and secures it to the frame assembly. The retainer tab 64 can be flat as shown in FIG. 3 or Z-shaped as shown in FIG. 7A as 64'. The Z-shaped retainer tab 64' is preferred since it eliminates the need for a longer shank 50, thereby reducing the fixed distance between a wall and the frame attached thereto. The retainer tab can be rotated on the shank away from the back panel in order to remove the back panel and access the contents located in the space bounded by the side panels 60. A threaded nut 66 engages screw threads on the shank 50. When the retainer tab 64 overlaps the back panel 18, the nut can be threaded onto the shank sufficiently to lightly press the back panel against the side panels 60 or against the object 16. This rotation of the nut 66 on the shank 50 occurs without need to hold the fastener manually against rotation because the flanged head 44 is held against rotation on the surfaces of the track channel 34.

A side channel 68, formed on the inner surface of each side face 54 of the peripheral border unit 11, extends along at least a portion of the length of the frame segments 20, 22, 24, 26 to the corner of the peripheral border unit 11 of the frame. Each side channel 68 is aligned with the side channels of adjacent frame segments, so that a side channel corner key 70 can engage the side channel 68 along at least a portion of the channel's length, thereby adding strength to the assembled frame 10.

FIG. 4 is an isometric view of the track channel corner key 28 for into contact with the front surface of the track channel 34 to secure it therein. FIG. 5 is an isometric view of the side channel corner key 70 for engaging the side channels 68 of adjacent frame segments at the corners. Attachment holes 74 contain set screws that are driven into contact with the inner surface of the side channel 68.

FIG. 6 is an isometric view showing a corner where adjacent segments 20, 22 are secured by track and side corner keys 28, 70. Preferably each leg of a corner key is about 1.0 inch long, 1.0 inch wide, and ⅛ inch thick.

Figure 7C:
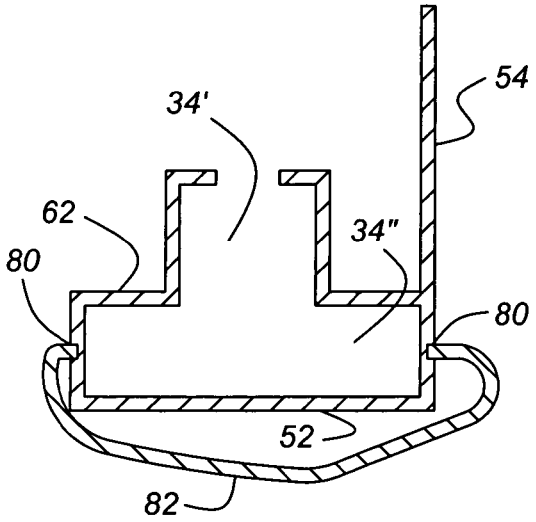
Figure 7D:
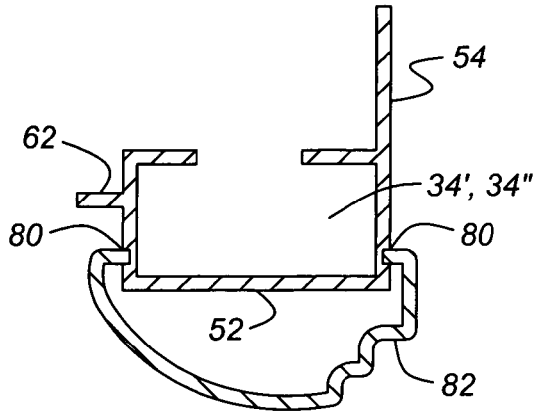
Figure 7E:
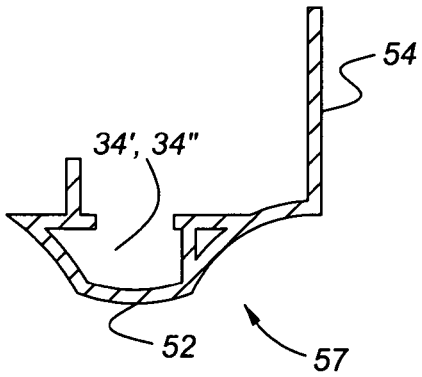

The cross sections of the frame's peripheral border unit 11 can have various shapes and sizes, including those shown in FIGS. 7A–7E, illustrating different configurations of channels. More specifically, in FIGS. 7A–7C a separate corner key track channel 34" for receiving corner keys 28, and a fastener track channel 34' for receiving fasteners 42, are shown. Further, the front face 52 of the peripheral boarder can have an outer surface 57 with an aesthetically ornamental appearance as shown in FIGS. 7B and 7E. However, in the preferred embodiment, the peripheral border unit 11 includes a pair of grooves 80 for securing a façade 82 to cover the front face 52. In assembly, the façade is cut to length to form mating angled ends for each segment 20, 22, 24, 26. The facade has engaging sides to slide along the grooves 80 and is secured in place when adjacent segments are secured by the track and side corner keys 28, 70.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A frame having a variable depth for displaying an object, comprising:

a peripheral border unit including a front face having a channel extending longitudinally therein, and a side face formed integrally with the front face;

a back-panel;

a retainer tab for engaging an outer surface of the back panel; and a fastener including a head for retention within the channel and an elongated shank extending from the head, for adjustably engaging the retainer tab along the shank and securing the back panel to the peripheral border unit.

2. The frame of claim 1, wherein:

the front face includes an outer surface and an inner surface, the channel being located at the inner surface, the channel including lateral surfaces extending along the channel;

the shank of the fastener is formed with screw threads, and the head is formed with surfaces for contacting the lateral surfaces of the channel, whereby the fastener is secured against rotation within the channel; and further comprising a threaded nut for engaging the screw threads of the fastener and securing the retainer tab in contact with the back panel.

3. The frame of claim 1, wherein:

the front face includes an outer surface and an inner surface, the channel being located at the inner surface, the channel including lateral surfaces extending along the channel;

the shank of the fastener is formed with screw threads, and the head is formed with surfaces for contacting the lateral surfaces of the channel, the fastener being secured against rotation within the channel and displaceable along the channel; and further comprising a threaded nut for engaging the screw threads of the fastener and securing the retainer tab in contact with the back panel at adjustable positions along the peripheral border unit.

4. The frame of claim 1, wherein the front face further comprises:

a second channel extending along the peripheral border unit having an opening facing the back panel; and a side panel for insertion in the second channel and extending from the front face toward the back panel to form a shadow box.

5. The frame of claim 1, wherein the peripheral border unit is formed in segments, each segment having a length extending along a side of the peripheral border unit, and wherein the front face of each segment further comprises:

a corner key having a first leg for engaging the channel of a first segment along at least a portion of the length of said channel, and a second leg directed angularly from the first leg for engaging the channel of a second segment along at least a portion of the length of said channel; and a façade covering an outer surface of the front face of each segment, the corresponding facade engageably connected to the segment by grooves.

6. The frame of claim 1, wherein the peripheral border unit is formed in segments, each segment having a length extending along a side of the peripheral border unit, and wherein the front face of each segment further comprises a track channel, each track channel being in a plane aligned with the track channel of an adjacent segment; and the peripheral border unit further comprises a corner key including a first leg for engaging the track channel of a first segment along at least a portion of the length of said track channel, and a second leg directed angularly from the first leg for engaging the track channel of a second segment along at least a portion of the length of said track channel.

7. The frame of claim 1, wherein the peripheral border unit is formed in segments, each segment having a length extending along a side of the peripheral border unit, and wherein the side face of each segment further comprises a second track channel; and the peripheral border unit further comprises a second corner key having a first leg for engaging the second track channel of a first segment along at least a portion of the length of said second track channel, and a second leg directed angularly from the first leg for engaging the second track channel of a second segment along at least a portion of the length of said second track channel.

8. The frame of claim 1, wherein the peripheral border unit is formed in segments, each segment having a length extending along a side of the peripheral border unit, and wherein the side face of each segment further comprises a second track channel, each second track channel being in a plane that is substantially perpendicular to the second track channel of an adjacent segment; and the peripheral border unit further comprises a corner key having a first leg for engaging the second track channel of a first segment along at least a portion of the length of said second track channel, and a second leg directed angularly from the first leg for engaging the second track channel of a second segment along at least a portion of the length of said second track channel.

9. The frame of claim 1, wherein:

the front face includes an outer surface, an inner surface, and an edge having a recess extending along the inner surface for receiving a sheet of glazing within the recess.

10. A frame having a variable depth for displaying an object, comprising:

a peripheral border unit having adjacent segments being mutually connected, each segment including a front face, a channel and a side face formed integrally with the front face and disposed angularly with respect to the front face;

a corner key for connecting adjacent segments;

a back panel;

retainer tabs, each retainer tab for contacting an outer surface of the back panel; and fasteners, each fastener including a head for retention within the channel of a segment, and an elongated shank extending from the head for adjustably engaging the retainer tab along the shank to secure the back panel to the peripheral border unit.

11. The frame of claim 10, wherein:

each front face includes an outer surface and an inner surface, the channel being located at the inner surface, the channel including lateral surfaces extending from the inner surface and along the channel;

the shank of each fastener is formed with screw threads, and the head is formed with surfaces for contacting the lateral surfaces and securing the fastener against rotation; and further comprising threaded nuts, each nut for engaging the screw threads of each fastener and securing one of the retainer tabs to the fastener and in contact with the back panel.

12. The frame of claim 11, wherein each segment further comprises:

a façade covering an outer surface of the segment's front face and the corresponding facade slideably engaging grooves of the segment.

13. The frame of claim 11, wherein each front face further comprises:

a second channel located at the inner surface, having a length extending along the peripheral border unit, a width bounded by lateral surfaces extending from the inner surface, and a height extending from the inner surface to an opening facing the back panel; and side panels, each side panel for insertion in a corresponding second channel between the lateral surfaces and extending from the inner surface of the front face toward the back panel.

14. The frame of claim 11, wherein each segment has a length extending along a side of the peripheral border unit, and wherein the corner key further comprises:

a first leg for engaging the channel of a first segment along at least a portion of the length of said channel, and a second leg directed angularly from the first leg for engaging the channel of a second segment along at least a portion of the length of said channel.

15. The frame of claim 11, wherein each segment has a length extending along a side of the peripheral border unit, and wherein the front face of each segment further comprises a track channel, each track channel being in a plane aligned with the track channel of an adjacent segment; and the corner key includes a first leg for engaging the track channel of a first segment along at least a portion of the length of said track channel, and a second leg directed angularly from the first leg for engaging the track channel of a second segment along at least a portion of the length of said track channel.

16. The frame of claim 11, wherein each segment has a length extending along a side of the peripheral border unit, and wherein the side face of each segment further comprises a second track channel; and the frame further comprises a second corner key having a first leg for engaging the track channel of a first segment along at least a portion of the length of said track second track channel, and a second leg directed angularly from the first leg for engaging the second track channel of a second segment along at least a portion of the length of said second track channel.

17. A frame having a variable depth for displaying an object, comprising:

a peripheral border unit having adjacent segments mutually connected, each segment including a front face having a channel being aligned with channels of adjacent segments and each segment having a pair of grooves;

a corner key having a first leg for engaging the channel of a first segment along at least a portion of the length of said channel, and a second leg directed angularly from the first leg for engaging the channel of a second segment along at least a portion of the length of said channel;

retainer tabs;

fasteners, each fastener including a head for retention within the channel, and an elongated shank extending from the head for adjustably engaging and securing the retainer tab to the peripheral border unit; and a façade engaging the segment grooves.

18. A frame having a variable depth for displaying an object, comprising:

a segmented peripheral border unit wherein adjacent segments are mutually connected, each segment having a front face including a first channel, and a second channel located at an inner surface of the front face and having an opening facing away from the front face for receiving a side panel extending from the inner surface of the front face, the first and second channels extending along each segment and aligned, respectively, with a first channel and a second channel of each adjacent segment;

retainer tabs; and fasteners, each fastener including a head for retention within the first channel, and an elongated shank extending from the head for adjustably engaging and securing the retainer tab to the segmented peripheral border unit.

* * * * *